United States Patent [19]

Suzuki et al.

[11] Patent Number: 5,065,126

[45] Date of Patent: Nov. 12, 1991

[54] LINEAR ACTUATOR

[75] Inventors: Hidemi Suzuki; Hiroyuki Yamada; Mikio Nakagawa, all of Saitama, Japan

[73] Assignee: Honda Giken Kogyo Kabushiki Kaisha, Tokyo, Japan

[21] Appl. No.: 371,888

[22] Filed: Jun. 27, 1989

[30] Foreign Application Priority Data

Jul. 25, 1988 [JP] Japan ..... 63-97296[U]

[51] Int. Cl.[5] ..... H01F 7/08

[52] U.S. Cl. ..... 335/222; 335/278

[58] Field of Search ..... 335/222, 223, 229, 230, 335/231, 278

[56] References Cited

U.S. PATENT DOCUMENTS 4,558,293 12/1985 Haneda et al. ..... 335/278 X
4,649,359 3/1987 Doki et al. ..... 335/222
4,698,608 10/1987 Kimble ..... 335/222
4,703,297 10/1987 Nagasaka ..... 335/222
4,808,955 2/1989 Godkin et al. ..... 335/222

*Primary Examiner*—George Harris
*Attorney, Agent, or Firm*—Pollock, VandeSande & Priddy

[57] ABSTRACT

In a linear actuator including a casing, an output shaft passing through the casing and being mounted slidably in a direction along the axis thereof, a solenoid coil disposed within the casing in coaxial relation to the output shaft, a magnet disposed in such a manner that the magnetic flux thereof is linked with windings of the coil, the output shaft mechanically connected to one of the magnet and the coil to form a movable part, and a spring adapted to urge the output shaft in one direction along the axis thereof, and a spacer made of high permeability material and interposed between the casing and either the coil or the magnet, whichever is fixed on the casing to form a stationary part.

4 Claims, 3 Drawing Sheets

PRIOR ART

LINEAR ACTUATOR

BACKGROUND OF THE INVENTION

1. Field of the Invention:

This invention relates to a linear actuator for linearly driving an output shaft with electromotive force, and more particularly to a linear actuator adapted to allow an electric current supplied to a coil to be efficiently converted into an electromagnetic force.

2. Description of the Prior Art:

The so-called voice coil type linear actuator is used in generating a motion of a relatively large stroke as in driving an exhaust gas recirculation valve or an air conditioning valve mounted in an automobile.

This actuator comes in two types, one type comprising a movable magnet formed integrally with an output shaft and a coil disposed stationarily within the magnetic field of the magnet and the other type conversely comprising a magnet disposed stationarily and a movable coil formed integrally with an output shaft. In the actuator of either of the types, when the coil is energized, the electromagnetic force consequently generated operates the coil and the magnet relative to each other and causes the output shaft to produce a linear motion.

One example of the linear actuator utilizing the above operating principle is disclosed in Japanese Utility Model Laid-Open Publication SHO 61(1986)-117,588.

FIG. 2 represents a cross section of a prior art movable magnet type actuator having a magnet and an output shaft integrated with each other, one of the two types of actuators mentioned above.

With reference to the diagram, an output shaft 1 is inserted in the central part of a cuplike magnet retaining member 2 made of an electrically insulating material such as resin and joined integrally with the retaining member 2 by a nut 3. To the outer surface of the retaining member 2, a magnet 4 is attached fast with adhesive agent.

A movable part 16 composed of the output shaft 1, the cuplike member 2, and the magnet 4 is adapted to be reciprocated as guided on the outer surfaces of a cylindrical guide member 7 and a bearing 6 installed in a casing 5. The guide member 7 is supported in the casing 5 with a supporting plate 7*a*.

One end of a coil spring 8 is engaged with a screw member 9 that is screwed into the center bore of the guide member 7 so as to permit adjustment of the amount of the strain given in advance to the coil spring 8. The other end of the coil spring 8 is kept in engagement with a projection at the bottom of the magnet retaining member 2.

As the result, the resilient force of the coil spring 8 presses the retaining member 2 in the direction of the bearing 6. The pressing force generated as described above by the coil spring 8 can be adjusted by moving the screw member 9 forward or backward in the axial direction of the spring 8 and the output shaft 1.

A coil 12 is positioned in the vertical direction by retaining plates 10*a*, 10*b* so as to encircle the magnet 4 in an open space between the casing 5 and the guide member 7.

The coil 12 is connected at one terminal thereof to a lead terminal 14 and at the other terminal to the other lead terminal (not shown). The lead terminal 14 is fixed in a terminal fixing plate 15 made of an electrically insulating material.

In the actuator constructed as described above, when an electric current is supplied to the coil 12, the electric current and the magnetic flux of the magnet 4 passing through a magnetic circuit 13 interlink to generate an electromagnetic force, by virtue of which the magnet 4 and consequently the movable part 16 are moved in the direction of compressing the coil spring 8.

As the movable part 16 is moved, the spring 8 is compressed more and more to increase a resilient force. The movable part 16 is brought to a stop at the position at which the electromagnetic force and the resilient force of the spring 8 are balanced. The amount of movement of the output shaft 1 from the position of rest assumed when no electric current is supplied to the coil 12 to the position of balance assumed when the movement of the movable part 16 is brought to a stop during the supply of electric current to the coil 12 constitutes itself the stroke of the actuator. The stroke of the actuator, therefore, is fixed by the magnitude of the electric current supplied to the coil 12 and the resilient force of the spring.

The conventional technique described above entails the following drawbacks.

The magnitude of the electromagnetic force generated by the electric current supplied to the coil 12 is dependent on the values of permeability of the component members of the magnetic circuit 13, namely the casing 5, the guide member 7, and the supporting plate 7*a* for the guide member 7. To be specific, the generation of the electromagnetic force by the supply of the electric current to the coil 12 is attained efficiently in proportion as the magnetic resistance of the magnetic circuit 13 is decreased and the magnetic flux of the magnet 4 is consequently increased. For the sake of the efficient generation of the electromagnetic force, the component members of the magnetic circuit 13 are desired to have large permeability.

Incidentally, the component members of the magnetic circuit 13 are manufactured by machining proper blanks in desired shapes. The materials for these component members, therefore, are required to possess satisfactory machinability. Particularly since the casing 5 has large dimensions and a complicated shape, the material used therefor is desired to possess highly satisfactory machinability.

It is, however, difficult to select from among various magnetic materials a particular material which simultaneously meets the requirements, i.e. high permeability, highly satisfactory machinability, and low cost. It has been inevitable to select the material for the casing at a sacrifice of either machinability or permeability.

The present invention has been produced for the purpose of solving the disadvantage described above.

SUMMARY OF THE INVENTION

For the solution of the problem, this invention contemplates a linear actuator which is characterized by interposing a spacer formed of a material of high permeability between a casing and either a magnet for generation of a magnetic field or a coil disposed within the magnetic field of the magnet, whichever is fixed in the casing to form a stationary part of a linear actuator.

In the present invention which is constructed as described above, since the spacer of high permeability forms a part of the magnetic circuit, the magnet is allowed to generate a large magnetic flux as compared with the conventional countertype and the coil is enabled to effect the conversion of the electric current supplied thereto into the electromagnetic force in improved efficiency.

In this case, the casing has no direct bearing on the formation of the magnetic circuit. The material to be used for the casing, therefore, is no longer required to possess high permeability but is merely required to possess satisfactory machinability. Thus, the selection of the material is made easy.

Unlike the casing, the spacer can be formed in a simple shape such as a ring or a tube. Thus, the material for the spacer is not restricted by the requirement that it should possess particularly satisfactory machinability. Now that permeability is the sole concern, the selection of the material can be attained easily.

The other objects and characteristic features of this invention will become apparent from the description to be given in further detail hereinbelow with reference to the accompanying drawings.

DETAILED DESCRIPTION OF THE PREFERRED EMBODIMENT OF THE INVENTION

Figure 1:
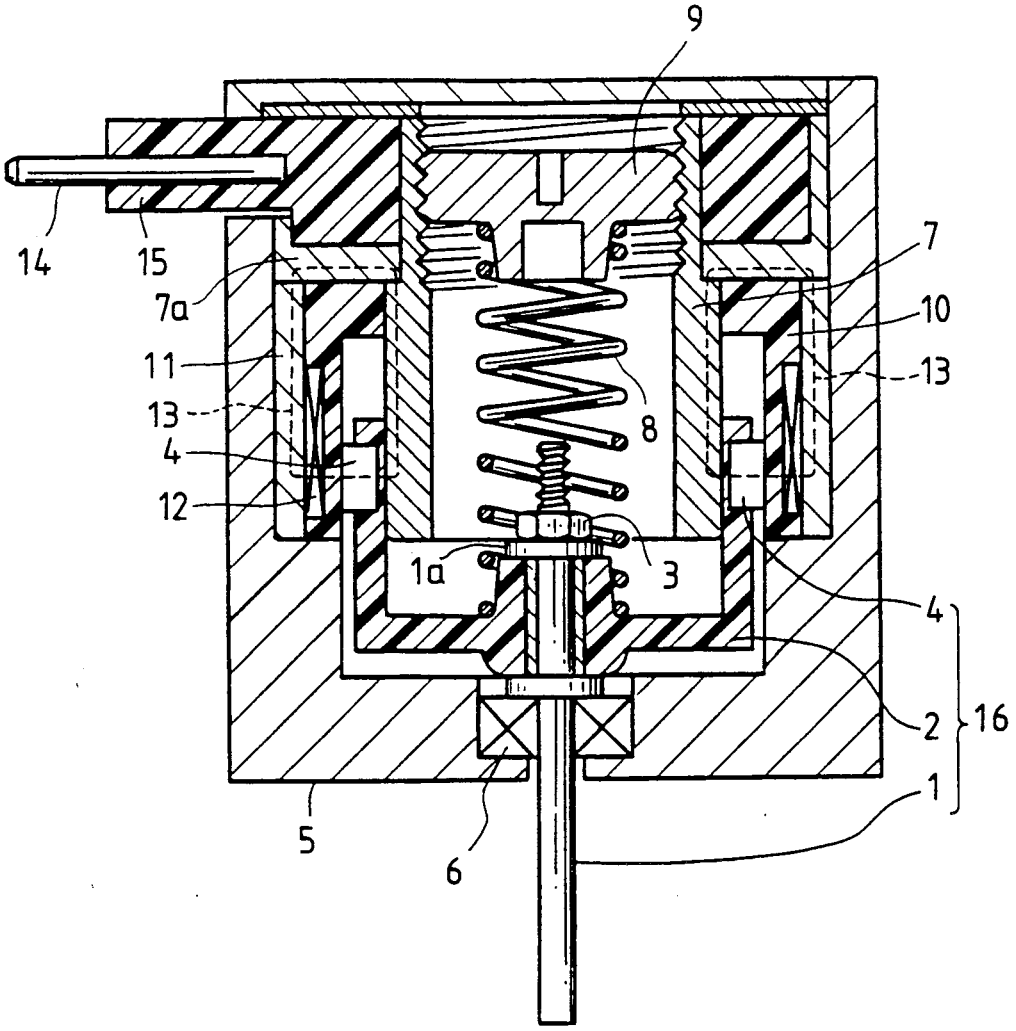
FIG. 1 is a cross section of an actuator according to one embodiment of the present invention.
Figure 2:
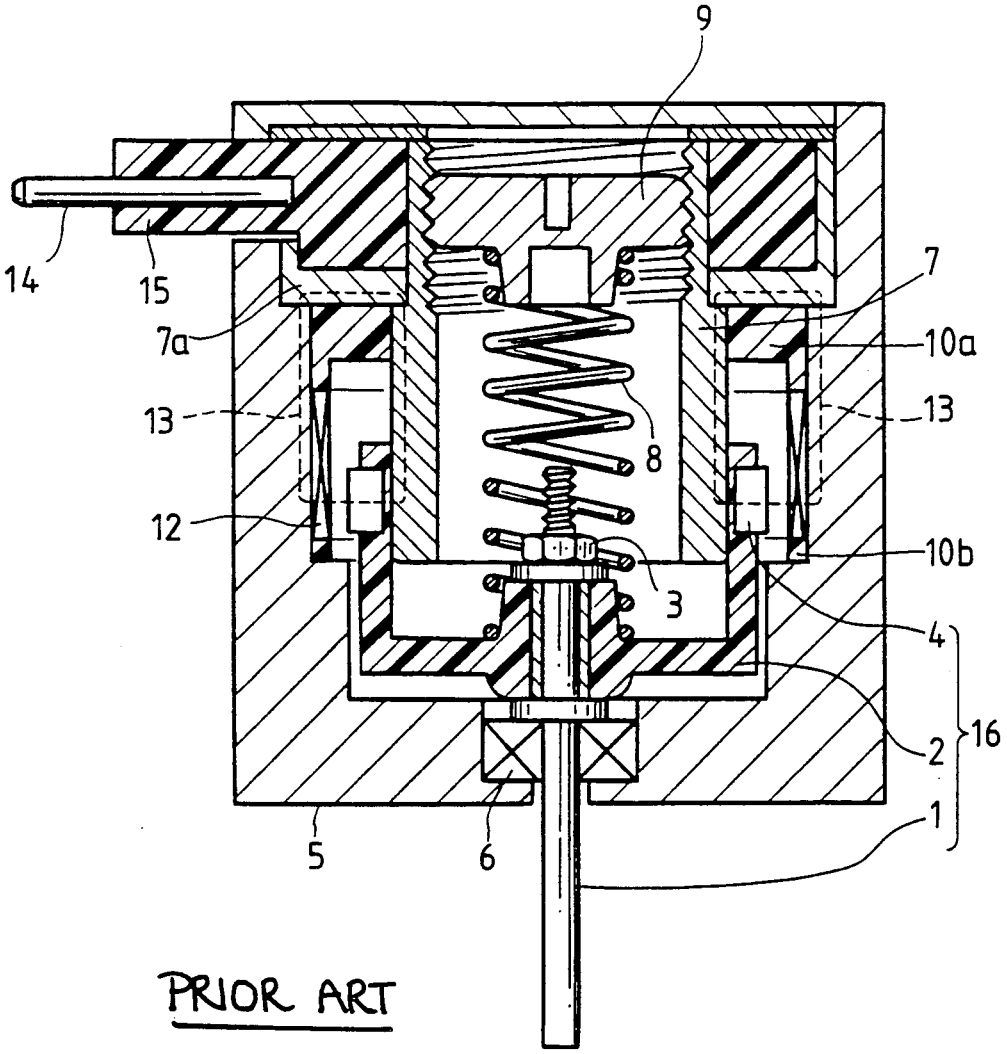
FIG. 2 is a cross section of the conventional actuator.

FIG. 1 is a cross section illustrating one embodiment of the present invention. In the diagram, the reference numerals which have equivalents in FIG. 2 denote identical or similar parts. A coil 12 is wound around the outer periphery of a cylindrical bobbin 10 made of an electrically insulating material. The coil 12, therefore, is opposed across the bobbin 10 to a magnet 4.

Further, a cylindrical spacer 11 is disposed in a space enclosed with the bobbin 10, casing 5 and supporting plate *7a*. The spacer 11 is destined to form a part of the magnetic circuit 13 of the magnet 4 and is made of a material of high permeability.

The present embodiment constructed as described above operates as follows.

When an electric current is supplied to the coil 12, the magnetic flux of the magnet 4 induced along the chain line 13 is linked with the electric current and caused to generate an electromagnetic force. The magnet 4 being a part of a movable body 16 is acted on by the electromagnetic force. Owing to the electromagnetic force, the magnet 4 and the movable part 16 are driven along the axial direction of the output shaft 1 as guided by the guide member 7 and/or the inner wall of the bobbin 10.

In the present embodiment, since the spacer 11 which forms a part of the magnetic circuit 13 possesses high permeability, the magnetic circuit 13 offers low magnetic resistance as compared with the conventional actuator in which part of the magnetic circuit 13 is formed with the casing 5. As the result, the electric current supplied to the coil 12 is efficiently converted into the electromagnetic force which is destined to act upon the magnet 4.

Further, since the spacer 11 is disposed within the tightly closed space, even when part of the spacer 11 is chipped off and finely comminuted by the external shock exerted on the actuator, the produced powder can be confined within the space accommodating the spacer 11. The otherwise possible short-circuiting between the magnet 4 and the coil 12 due to the scattering of the powder can be avoided.

Figure 3:
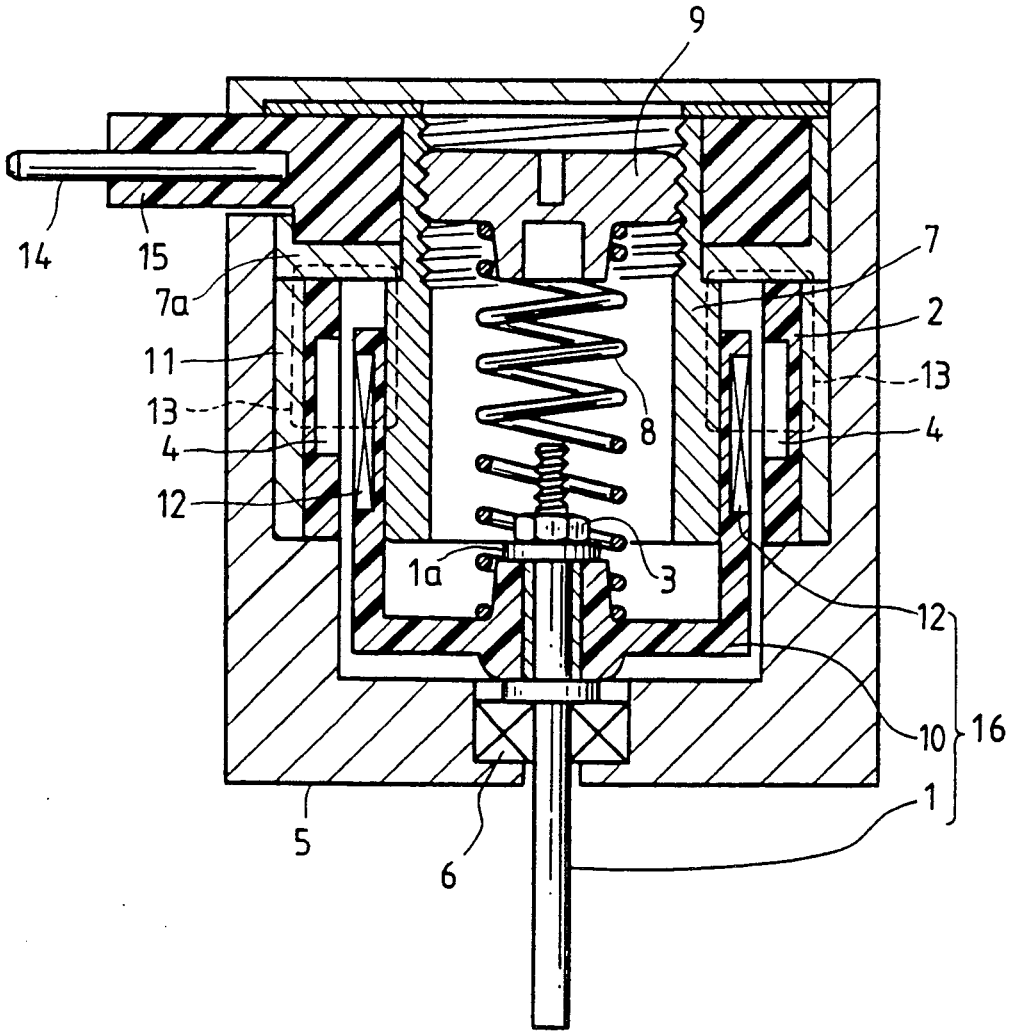
FIG. 3 is a cross section of an actuator according to another embodiment of the present invention.

FIG. 3 illustrates another embodiment of the invention wherein the coil 12 is mechanically connected to the output shaft 1, and the magnet 4 is fixed on the casing 5 and interposed between the high permeability material spacer 11 and the coil 12. The other numerals in FIG. 3 designate parts identified by like numerals in FIGS. 1 and 2.

As clearly noted from the description given above, this invention attains the following effects:

(1) Since it permits formation of a magnetic circuit of low magnetic resistance, it allows the magnet to generate an increased magnetic flux and enables the electric current supplied to the coil to be efficiently converted into an electromagnetic force.

(2) Since it allows the casing to be made of a material of satisfactory machinability, the time required for the machining can be shortened and the cost of production lowered.

(3) Since the material for the casing demands no consideration for permeability, the material fit for the casing can be freely selected from among various materials, depending on the particular application intended for the actuator.

What is claimed is:

1. A linear actuator including a casing, an output shaft passing through the casing and being mounted slidably in a direction along the axis thereof, a solenoid coil disposed within the casing in coaxial relation to the output shaft, a magnet disposed in such a manner that the magnetic flux thereof is linked with windings of the coil, the output shaft mechanically connected to one of the magnet and the coil to form a movable part, and a spring coupled to said output shaft to continously urge such shaft in one direction along the axis thereof, wherein the electromagnetic force generated by the energization of the coil linearly moves the movable part in the opposite direction along the axis of the output shaft against the resilient force of the spring, which linear actuator comprising a spacer made of a high permeability material and interposed between the casing and either the coil or the magnet, whichever is fixed on the casing to form a stationary part.

2. A linear actuator as claimed in claim 1, wherein the magnet is a cylindrical permanent magnet.

3. A linear actuator as claimed in claim 1, wherein the magnet is mechanically connected to the output shaft, and the coil is fixed on the casing and interposed between the high permeability material spacer and the magnet.

4. A linear actuator as claimed in claim 1, wherein the coil is mechanically connected to the output shaft, and the magnet is fixed on the casing and interposed between the high permeability material spacer and the coil.

* * * * *